US005685444A

United States Patent [19]

Valley

[11] Patent Number: 5,685,444

[45] Date of Patent: Nov. 11, 1997

[54] TAMPER-EVIDENT HINGED CLOSURE CAP CONSTRUCTION

[76] Inventor: Joseph P. Valley, 103 Metro Trail, Hopatcong, N.J. 07843

[21] Appl. No.: 530,419

[22] Filed: Sep. 19, 1995

[51] Int. Cl.[6] ..... B65D 41/32

[52] U.S. Cl. ..... 215/253; 215/237; 215/250

[58] Field of Search ..... 215/235, 237, 215/238, 250, 253

[56] References Cited

U.S. PATENT DOCUMENTS

| | | | |
|---|---|---|---|
| 2,125,788 | 8/1938 | Johnson . | |
| 2,987,206 | 6/1961 | Grussen . | |
| 3,348,718 | 10/1967 | Musy . | |
| 3,455,478 | 7/1969 | Fields et al. . | |
| 3,465,906 | 9/1969 | Wagner et al. . | |
| 3,650,428 | 3/1972 | Miller . | |
| 3,673,761 | 7/1972 | Leitz . | |
| 3,920,503 | 11/1975 | Keeler . | |
| 3,929,246 | 12/1975 | Leitz . | |
| 4,156,490 | 5/1979 | Peraboni . | |
| 4,197,955 | 4/1980 | Luenser . | |
| 4,241,841 | 12/1980 | Boller . | |
| 4,278,180 | 7/1981 | Willis . | |
| 4,291,813 | 9/1981 | Allen et al. . | |
| 4,299,328 | 11/1981 | Ochs et al. . | |
| 4,352,436 | 10/1982 | Chartier et al. . | |
| 4,385,708 | 5/1983 | Curry . | |
| 4,402,415 | 9/1983 | Hopley . | |
| 4,478,343 | 10/1984 | Ostrowsky . | |
| 4,485,934 | 12/1984 | Maguire . | |
| 4,494,663 | 1/1985 | Bertaud et al. . | |
| 4,513,870 | 4/1985 | Zaltsman . | |
| 4,546,893 | 10/1985 | Stull . | |
| 4,570,825 | 2/1986 | Stull . | |
| 4,795,044 | 1/1989 | Beck | 215/237 |
| 4,974,735 | 12/1990 | Newell et al. | 215/253 |
| 5,012,941 | 5/1991 | Abrams et al. | 215/250 |
| 5,133,470 | 7/1992 | Abrams | 215/250 |
| 5,392,938 | 2/1995 | Dubach | 215/254 |

*Primary Examiner*—Stephen Cronin
*Attorney, Agent, or Firm*—H. Gibner Lehmann

[57] ABSTRACT

A tamper-evident closure cap construction having a cap body part for attachment to a container neck, a closure cap part, and a hinge connecting the closure cap part to the cap body part. The latter has an upper discharge opening, and the closure cap part is movable between a closed, sealing position covering the discharge opening, and an open, discharge position wherein the closure cap part is removed from the discharge opening. There are selectively manually operable locking components for locking the closure cap part in the closed, sealing position. The manually operable locking components have a first position corresponding to a closed, but unlocked condition of the closure cap part, and a second position corresponding to a closed and locked condition of the closure cap part. The components, once locked manually, are permanently retained in the second position so as to prevent tamper-type removal of the closure cap part from the cap body part.

14 Claims, 2 Drawing Sheets

TAMPER-EVIDENT HINGED CLOSURE CAP CONSTRUCTION

CROSS REFERENCES TO RELATED APPLICATIONS

1. My co-pending Design Application, U.S. Ser. No. 29/040,350 filed Jun. 15, 1995, entitled TAMPER-EVIDENT SAFETY CLOSURE CAP, and having common ownership with the present application.

STATEMENT AS TO RIGHTS TO INVENTIONS MADE UNDER FEDERALLY SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates generally to tamper-evident closure caps, and more particularly to caps of a type having a captive closure cap secured to a base or cap body by a flexible hinge structure.

2. Description of the Related Art Including Information Disclosed Under 37 CFR Sections 1.97–1.99

A representative sample of prior, known tamper-evident cap constructions is disclosed in the following patents:

| U.S. Pat. Nos.: | | |
|---|---|---|
| 2,125,788 | 2,987,206 | 3,348,718 |
| 3,455,478 | 3,465,906 | 3,650,428 |
| 3,673,761 | 3,920,503 | 3,929,246 |
| 4,156,490 | 4,197,955 | 4,241,841 |
| 4,278,180 | 4,291,813 | 4,299,328 |
| 4,352,436 | 4,385,708 | 4,402,415 |
| 4,478,343 | 4,485,934 | 4,494,663 |
| 4,513,870 | 4,546,893 | 4,570,825 |

Many of the devices illustrated in the above identified patents utilize various types of frangible webs between a retainer ring that is intended to be held captive on a container neck, and a closure cap. In some instances, a tear-away band having lines of weakness along its length is employed in order to facilitate separation of the cap from the ring. In other cap constructions, different combinations of tear-away bands and zones of weakness are utilized in order to provide the desired, tamper-resistant feature.

With particular reference to the patents listed hereinabove, U.S. Pat. No. 2,125,788 shows an early construction for a specially-fabricated bottle having an upwardly facing groove at its neck, wherein a metal cup-like closure is secured over a screw cap, the metal closure having two score lines (40) which facilitate removal of the closure by the consumer. The metal closure is secured in the groove at the container neck, by a pressed-in locking ring, which retains the lower portion of the closure when the upper part is broken away.

Another early design is illustrated in U.S. Pat. No. 2,987,206, which involves a plastic cap having a series of peripheral depending tongues that overlie an external bead on a container neck, and which are held in place by a tear strip. The latter can be ruptured by forcibly prying any of the tongues upwardly, thereafter enabling the cap to be removed.

U. S. Pat. Nos. 3,348,718; 3,455,478; 3,673,761; 3,929,246; 4,156,490; 4,241,841; 4,278,180; 4,299,328; 4,352,436; and 4,485,934 illustrate still other arrangements involving frangible bridge portions that join a screw cap to a captive ring on a container neck. In each instance, the initial, forcible unscrewing of the cap by the consumer causes the bridge portions to rupture, indicating to the user that the respective container has been opened.

U.S. Pat. No. 4,197,955 illustrates a tamper-evident construction utilizing a container provided with an integral external neck flange, and a screw cap that is carried on the neck, the cap and flange being connected by multiple thin webs. The webs are arranged such that upon initial forcible unscrewing of the cap, they readily break, providing the desired tamper-evident indication.

U.S. Pat. No. 4,291,813 discloses an integrally formed screw cap and locking web for a container, the web having an undercut configuration, and being initially molded in a folded-up position on the cap. During application of the cap, the web is forcibly unfolded so as to lockingly engage a corresponding undercut on the exterior of the container neck.

U.S. Pat. No. 3,920,503 relates to a method of manufacturing a tamper-evident closure utilizing a heat-probe to form depressions in a screw cap, which depressions also extend to the underlying neck so as to create a mechanical interlock between the cap and neck. There is also disclosed the use of ultrasonic welding equipment to form such depressions.

Additional examples of the use of tear-strips for tamper-evident dispensers include the devices shown in U.S. Pat. Nos. 4,385,708; 4,402,415; and 4,494,663.

U.S. Pat. No. 4,478,343 discloses a cap construction comprising a screw cap and locking band connected thereto by frangible webs, the band having a plurality of inwardly-extending locking tabs that underlie and interlock with an external bead on a container or bottle.

U.S. Pat. No. 4,513,870 relates to a stopper or cork for a wine bottle, the cork being connected to a captive ring on the bottle neck by a plurality of webs. One or more of the webs are intended to rupture at the time the bottle is initially opened, with still others of the webs being arranged to remain intact, so as to hold the cork captive on the neck and prevent it from forcibly "popping" out from the neck, as can often occur with containers carrying liquids that are under pressure.

Finally, more recent U.S. Pat. Nos. 4,570,825 and 4,546,893illustrate tamper-evident cap constructions which are intended to provide improved visibility to the consumer, as to the condition of tamper-resistant, rupturable structures on the containers. In both patents, these structures face generally upwardly, so that they are readily observable at the time that the consumer first handles the container.

While some of the devices noted have been commercialized, there have existed logistical problems in the use of tamper-evident containers in the case where the bottle and cap per se were made by one company and subsequently shipped to another concern, for filling of the contents. With conventional tramper-evident containers, it was frequently necessary to fill the containers prior to installation of the closure caps thereon. The problem was compounded by the fact that the party charged with the filling was frequently not experienced with automatic assembly equipment, especially that involved with installation of tamper-evident closures. Since the filled-but-uncapped containers were susceptible of contamination if they were not immediately sealed off in an acceptable manner, it has been customary to have the containers capped by the same party doing the filling, necessitating the locating of capping equipment at the filling facility.

Such a practice was not always convenient, or cost-effective.

SUMMARY OF THE INVENTION

The above disadvantages and drawbacks of prior tamper-evident closure constructions are largely obviated by the present invention, which has for one object the provision of a novel and improved tamper-evident closure cap construction which is simple in its structure, and which greatly facilitates the production and filling of tamper-evident containers, and in a convenient and cost-effective manner.

Still another object of the invention is to provide an improved tamper-evident closure cap construction as above set forth, which lends itself to virtually complete assembly at one location, while accommodating a filling operation at a separate location, with special attention to freedom from inadvertent contamination of the containers, both in an empty and a filled condition.

Still another object of the invention is to provide an improved tamper-evident closure cap construction in accordance with foregoing, wherein the tamper-evident feature can, if desired, be activated by the party performing the filling operation, and with relatively simple equipment, or else manually.

Yet another object of the invention is to provide an improved tamper-evident closure cap construction as above characterized, wherein the parts can be economically molded in simple mold cavities, thereby reducing manufacturing expense. In a preferred embodiment, the entire cap assembly is molded as a single integral piece.

The above objects are accomplished by a tamper-evident closure cap construction, comprising in combination a cap body part having means for attachment to a container neck, a closure cap part, and hinge means connecting the closure cap part to the cap body part. The cap body part has an upper discharge opening. The closure cap part is movable between a closed, sealing position covering the discharge opening, and an open, discharge position wherein the closure cap part is removed from the discharge opening. Cooperable means are provided on the cap body part and closure cap part, located diametrically opposite the hinge means and providing a selectively manually operable locking structure for securing the closure cap part in the closed, sealing position against dislodgement therefrom. The manually operable locking structure has means providing a zone of weakness adapted to rupture if the closure cap part is forced open from its closed, locked position, rupturing of the zone of weakness thereafter providing a visual indication that the closure cap construction has been tampered with.

The arrangement is such that the closure cap construction can assume either a locked or unlocked condition when disposed in its closed position. The closed, unlocked condition is useful during and after assembly of the caps to suitable containers, but prior to filling thereof. In such a state, the containers can, if necessary, be shipped to the filling facility. Because the caps are closed, no inadvertent contamination occurs, as during packing, shipment, and unpacking. At the filling facility, the caps are opened, the containers filled, and thereafter the caps re-closed and locked, so as to assume a tamper-evident condition. The filled, tamper-evident containers can then be shipped to a store or warehouse, as required.

Thus, the steps required at the filling station can be greatly simplified, due to the close-and-unlock and close-and-lock features of the cap constructions, as noted above.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT

Figure 3:
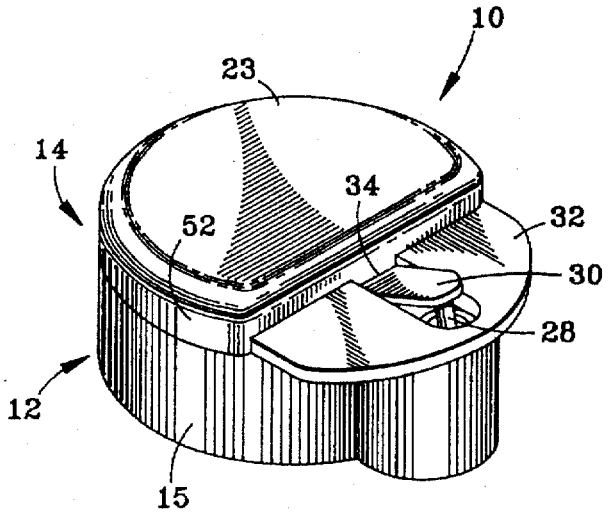
FIG. 3 is a perspective view of the cap construction of FIGS. 1 and 2, showing the closure cap portion thereof in a closed, but unlocked position.
Figure 7:
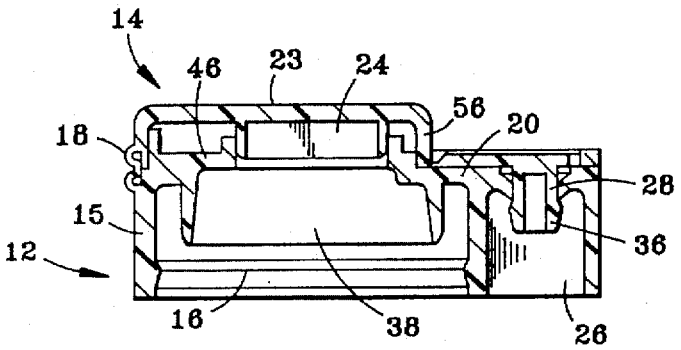
FIG. 7 is an axial section like FIG. 5, excepting showing the closure cap portion in a closed, locked position.

Referring first to FIG. 3 there is illustrated a closure cap construction generally designated by the numeral 10, comprising a cap body part 12 and a closure cap part 14, the cap body part 12 having a depending skirt 15 and means for attachment to a container neck (not shown), the attachment means being shown in FIG. 7 as an annular bead 16 on the skirt 15, capable of being snapped over a cooperable external bead on the container neck, in a known manner. Hinge means 18 are provided, joining the closure cap part 14 to the cap body part 12 and enabling the said parts and hinge means 18 to be molded as a single integral piece.

Figure 5:
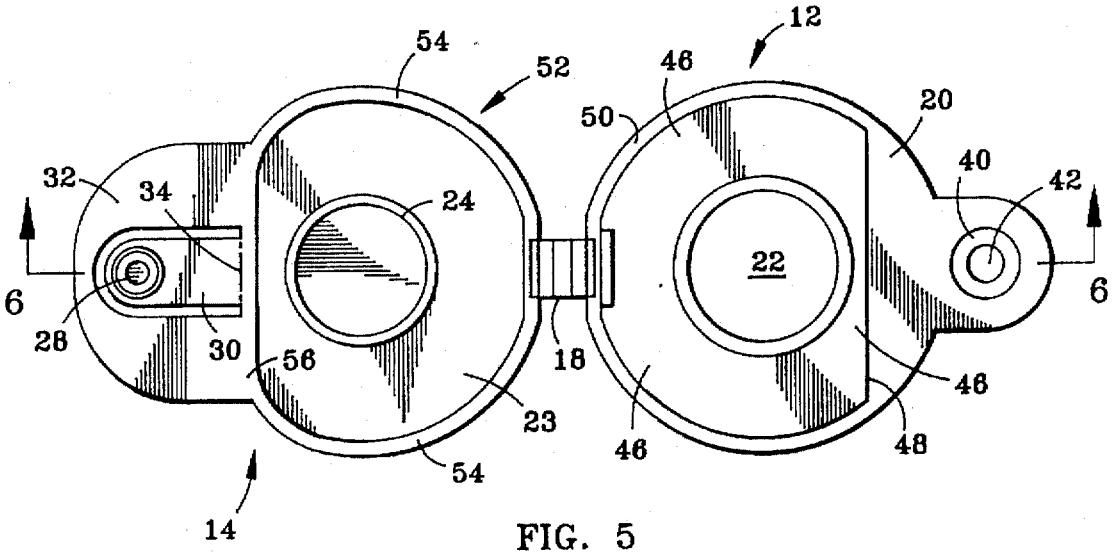
FIG. 5 is a top plan view of the tamper-evident cap construction of FIGS. 1–4, with the closure cap portion thereof in an open position.
Figure 6:
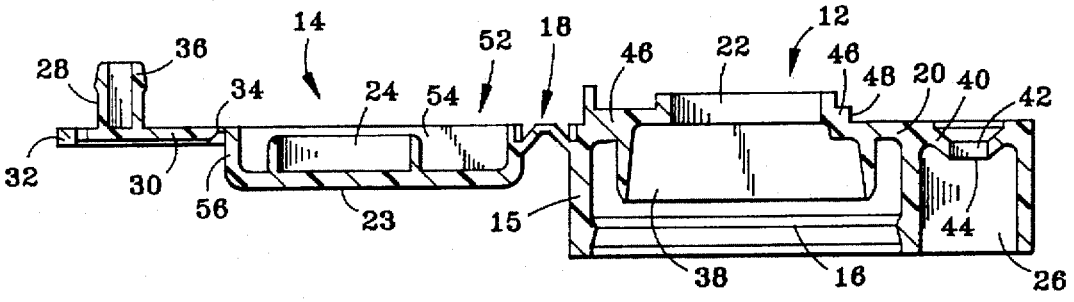
FIG. 6 is an axial section taken on the line 6—6 of FIG. 5.

The cap body part 12 has a transverse top wall 20, FIGS. 5 and 6, with an orifice or discharge opening 22. The opening 22 can optionally be provided with a slightly tapered lead-in bevelled surface, too slight to be shown. On the underside of the top wall 23 of the closure cap part 14 is a depending sealing plug 24 adapted to be received in the discharge opening 22 for sealing the latter.

The closure cap part 14 is swingable on the cap body part 12 between a first, open or discharge position indicated in FIGS. 5 and 6 and a second, closed or sealing position indicated in FIGS. 1–3 and 7. In the latter position, the plug 24 sealingly engages the walls of the discharge opening 22, all in a known manner, per se.

In accordance with the present invention there are provided on the cap body part 12 and on the closure cap part 14, cooperable novel means located diametrically opposite to the hinge means 18, providing a selectively manually operable locking structure for securing the closure cap part 14 in the closed, sealing position against dislodgement therefrom, said locking structure having means providing a zone of weakness adapted to rupture if the closure cap part 14 is forced open from its closed position.

In a preferred embodiment of the invention the locking structure comprises means defining a retainer socket 26 on the cap body part 12, and a retainer pin 28 carried on the closure cap part 14. The retainer pin 28 is disposed on a tongue or actuator member or part 30 which is bordered by a U-shaped opening in a lifting edge or finger tab 32 of the closure cap part 14. The tongue 30 is connected to the tab 32 by a thin hinge or web 34, constituting a zone of weakness. The extremity of the pin 28 is provided with an enlarged head 36, preferably having a tapered lead-in surface and an undercut as seen in FIG. 6.

The cap body part 12 has a concentric through bore 38, and the socket 26 is in the form of a tubular bore disposed at one side of the through bore 38, having a transverse wall 40, provided with a hole 42 at its center. Preferably the wall 40 is of generally conical configuration, similar to a funnel, with the hole 42 being disposed at the apex of the conical configuration as shown. The opposite sides of the transverse wall 40 are both fully accessible from the top and bottom ends respectively of the socket 26. The hole 42 has a lower circular edge 44 which cooperates with the undercut shoulder of the head 36 of the pin 28 to provide a one-way locking action as in the form of a by-passing movement of the head 36 through the hole 42 when the pin 28 is pressed therein, as will be explained further below.

Figure 1:
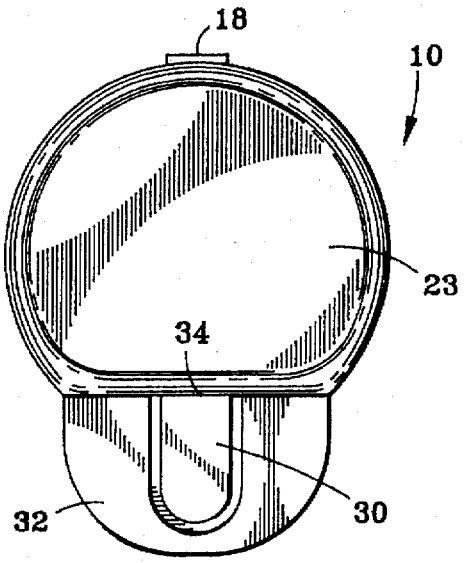
FIG. 1 is a top plan view of the tamper-evident cap construction of the present invention, with the closure cap portion thereof disposed in a closed, sealing position.
Figure 2:
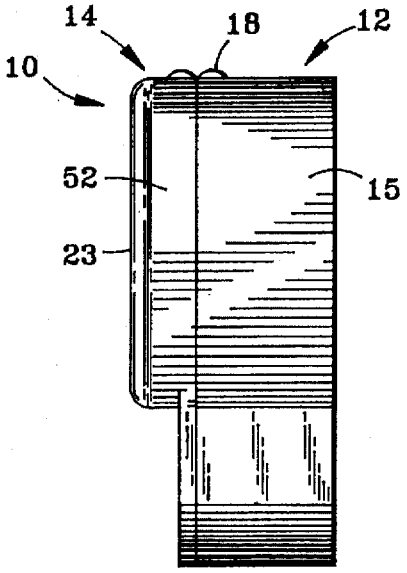
FIG. 2 is a right side elevation of the cap construction of FIG. 1.

Additionally, in accordance with the invention, there are provided cooperable registration means on the cap body part 12 and on the closure cap part 14, restraining the parts against inadvertent relative turning movement when the closure cap part 14 is disposed in its closed sealing position, as in FIGS. 2, 3 and 7. In accomplishing such registration, the cap body part 12 is provided with a D-shaped raised plateau 46 shown as being of non-circular configuration, forming a shoulder 48. The major of portion the plateau, apart from the shoulder 48, is seen to be generally circular when viewed from above, having a semi-cylindrical keying shoulder 50, FIG. 5. The closure cap part 14 has a depending outer skirt 52, including a mostly circular portion 54 and a straight shoulder portion 56, the latter being adapted for interfitting engagement with the shoulder 48 of the plateau 46 when the closure cap part 14 is disposed in its closed, sealing position. Thus, it can be seen that the engagement of the shoulders 56 and 48 in effect keys the closure cap part 14 to the cap body part 12, and prevents relative turning there-between. Such turning could otherwise lead to undesirable stresses on the hinge means 18, causing possible breakage thereof and in turn, defeating the locking feature of the construction.

In operation, the tamper-evident construction of the present invention provides unusual flexibility in that the closure, when in its closed position, can assume either a locked or an unlocked condition. In an unlocked condition, the closure cap part can be opened and closed at will by the user, merely by engagement of the lifting tab 32 by the consumer.

Referring to FIG. 6, it can be seen that the tongue 30 occupies a position which is generally coplanar with respect to the finger tab 32 of the closure cap part 14 when the latter is in its open position. The depending retainer pin 28 is, under such circumstances, perpendicular to the tab 32. As the closure cap part 14 is being seated on the cap body part 12, the end of the retainer pin 28 approaches the hole 42 and engages the transverse wall 40. However, continued movement of the closure cap part 14 does not continue the downward movement of the retainer pin 28 and tongue 30. Instead, the tongue 30 and pin 28 eventually become automatically raised above the tab 32 of the closure cap part, as in FIG. 3, thereby to automatically indicate to the user, that the tongue 30 and pin 28 are not in a locking position. Thus, this position corresponds to the closed but unlocked condition of the container, wherein the pin 28 has not been forced fully into the socket 26.

Figure 4:
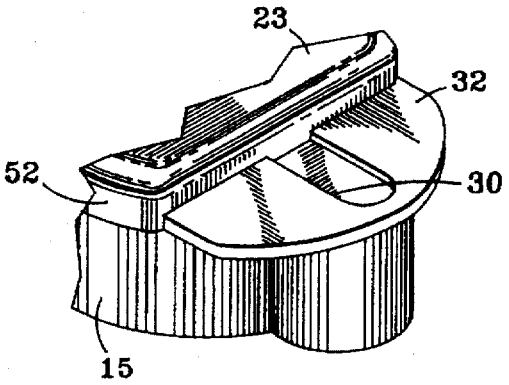
FIG. 4 is a view like FIG. 3, except showing the closure cap portion thereof in a closed, locking position.

At such time as it is desired to lock the closure against tampering, as in the case where the containers have just been filled, there is merely applied a downward force to the projecting tongue 30 from the position of FIG. 3, which in turn drives the pin 28 fully into the socket 26. The depressed position of the tongue as in FIG. 4 provides a visual indication that the closed cap part 14 is now also in a locked condition. The pin 28 and socket 26 thus constitute cooperable locking parts.

Following such locking, any subsequent attempts to open the closure cap part will result in rupturing of the web 34, which connects the tongue 30 and shoulder portion 56. Thus, the tongue 30 and pin 28 will remain with the cap body part, and the torn edge of the web 34 will be readily visible to the consumer, providing an indication that the cap has been previously opened, from its locked position.

The disclosed construction thus differs from many prior tamper-evident structures, especially those noted in the preamble of the present specification. A large number of known tamper-evident caps utilized molded caps and retainer rings having integral frangible webs, the caps being assembled by the manufacturer and applied to the containers after the latter had been filled with the intended product, and which were then ready for shipment and sale.

In contrast, the present invention provides a closure construction which can be selectively opened and closed any number of times, and which has provision for selectively manually locking the closure after the final closure operation.

This is especially useful for dispensers employing caps that are manufactured and assembled at one facility, thereafter being capable of closure to avoid contamination, and transferred to another facility where product is intended to be introduced into the container with the cap already in place on the container.

With such an arrangement, the closed, unlocked containers, after arriving at the filling facility, can be opened, filled, re-closed, and thereafter locked, so as to activate, so to speak, the tamper-evident feature, but only at the desired stage of production, namely after the containers have been filled and are ready to ship.

The disclosed device is both simple in its structure, and economical to manufacture, since a single mold cavity can be utilized to produce the structures shown.

Also, with such arrangement, potential problems with contamination of the interior of a container are largely circumvented, since during shipment of the assembled caps and containers, the caps can be put in the closed, unlocked condition to prevent dirt or debris from entering the container interior. Thereafter, at the filling facility, it is a relatively simple matter to open the caps, introduce the product into the container, and re-close and lock the caps so as to render them ready for shipment, while in a tamper-evident condition, to the consumer. The device is thus especially adapted for use with containers that require filling with the caps already in place. It is to be noted that in many prior constructions, it was necessary to first fill a container, and thereafter apply a tamper-evident cap. Under some circumstances this created problems since it required that the capping equipment be physically located at the filling facility. Such a requirement has more often than not, been inconvenient at best; frequently containers are manufactured by one concern, and the closure caps are manufactured by a second. Also, the producer of the product often constituted a third, different party. With the present invention, such logistic problems are largely overcome.

The disclosed device is thus seen to represent a distinct advance and improvement in the field of tamper-evident dispenser constructions.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A tamper-evident closure cap construction, comprising in combination:

a) a cap body part having means for attachment to a container neck, said cap body part having an upper discharge opening, b) a closure cap part, and hinge means connecting said closure cap part to said cap body part, said closure cap part being movable between a closed, sealing position covering said discharge opening, and an open, discharge position wherein the closure cap part is removed from the discharge opening, and c) cooperable means on said cap body part and closure cap part, located diametrically opposite said hinge means and providing a selectively manually operable locking structure for securing the closure cap part in said closed, sealing position against dislodgement therefrom when the latter is in said closed position, d) said manually operable locking structure having means providing a zone of weakness adapted to rupture if the closure cap part is forced open from its closed position, the rupturing of said zone of weakness resulting in shifting of part of said locking structure to thereby provide a visual indication that the closure cap construction has been tampered with, e) said manually operable locking structure comprising means defining a retainer socket on one of said cap parts, and a retainer pin carried on the other of said cap parts, said retainer pin locking in the retainer socket to effect the said locking of the closure cap part, f) said closure cap part having a transverse wall portion providing a finger-engageable lifting edge, said transverse wall portion being disposed opposite the location of the hinge means, g) said transverse wall portion having a substantially U-shaped slot defining a tongue having a U-shaped perimeter therein, h) said retainer pin being located on and carried by said tongue, and i) said retainer pin being disposed generally perpendicular to said transverse wall portion and said tongue when the closure cap part is disposed in its open, discharge position prior to engagement of the locking structure.

2. A tamper-evident closure cap construction, comprising in combination:

a) a cap body part having means for attachment to a container neck, said cap body part having an upper discharge opening, b) a closure cap part, and hinge means connecting said closure cap part to said cap body part, said closure cap part being movable between a closed, sealing position covering said discharge opening, and an open, discharge position wherein the closure cap part is removed from the discharge opening, and c) cooperable means on said cap body part and closure cap part, located diametrically opposite said hinge means and providing a selectively manually operable locking structure for securing the closure cap part in said closed, sealing position against dislodgement therefrom when the latter is in said closed position, d) said manually operable locking structure having means providing a zone of weakness adapted to rupture if the closure cap part is forced open from its closed position, the rupturing of said zone of weakness resulting in shifting of part of said locking structure to thereby provide a visual indication that the closure cap construction has been tampered with, e) said manually operable locking structure comprising means defining a retainer socket on one of said cap parts, and a retainer pin carried on the other of said cap parts, said retainer pin locking in the retainer socket to effect the said locking of the closure cap part, f) said closure cap part having a transverse wall portion providing a finger-engageable lifting edge, said transverse wall portion being disposed opposite the location of the hinge means, g) said transverse wall portion having a substantially U-shaped slot defining a tongue having a U-shaped perimeter therein, h) said retainer pin being located on and carried by said tongue, and i) said retainer pin being disposed generally perpendicular to said transverse wall portion and said tongue when the closure cap part is disposed in its open, discharge position to engagement of the locking structure j) said tongue and retainer pin becoming skewed with respect to said transverse wall portion when the closure cap part is disposed in its closed position and prior to activation of said manually operable locking structure.

3. A tamper-evident closure cap construction, comprising in combination:

a) a cap body part having means for attachment to a container neck, said cap body part having an upper discharge opening, b) a closure cap part, and hinge means connecting said closure cap part to said cap body part, said closure cap part being movable between a closed, sealing position covering said discharge opening, and an open, discharge position wherein the closure cap part is removed from the discharge opening, and c) cooperable means on said cap body part and closure cap part, located diametrically opposite said hinge means and providing a selectively manually operable locking structure for securing the closure cap part in said closed, sealing position against dislodgement therefrom when the latter is in said closed position, d) said manually operable locking structure having means providing a zone of weakness adapted to rupture if the closure cap part is forced open from its closed position, the rupturing of said zone of weakness resulting in shifting of part of said locking structure to thereby provide a visual indication that the closure cap construction has been tampered with, e) said manually operable locking structure comprising means defining a retainer socket on one of said cap parts, and a retainer pin carried on the other of said cap parts, said retainer pin locking in the retainer socket to effect the said locking of the closure cap part, f) said retainer socket being disposed on said cap body part, said socket providing a hole and a tapered guide wall surrounding the upper perimeter of said hole, said tapered guide wall being engaged by the end of said retainer pin so as to centralize the latter when the closure cap part is disposed in its closed, sealing position, g) said retainer pin being connected to the closure cap part by a resilient tongue, h) the engagement of the retainer pin with the tapered guide wall dislodging the tongue and halting the movement of both the tongue and the retainer pin as the closure cap part is shifted to its closed position, and i) said tongue assuming a raised, skewed position with respect to the closure cap part as a consequence of said engagement, when the closure cap part arrives at its fully closed position.

4. A tamper-evident closure cap construction, comprising in combination:

a) a cap body part having means for attachment to a container neck, said cap body part having an upper discharge opening, b) a closure cap part having a top wall, and hinge means connecting said closure cap part to said cap body part, said closure cap part being movable between a closed, sealing position covering said discharge opening, and an open, discharge position wherein the closure cap part is removed from the discharge opening, c) an externally actuatable member carried by said closure cap part, said member being directly accessible from above the top wall thereof when the closure cap part is disposed in its closed, sealing position, and d) cooperable locking means on said actuatable member and cap body part, comprising a pair of engageable locking parts one of which is carried by said actuatable member, e) said actuatable member comprising a flat hinged tongue which is hinged secured to the top wall of the closure cap part, said tongue being moveable, while the closure cap part is disposed in its closed, sealing position, from a raised position toward a lowered position with respect to the top wall of said closure cap part, f) movement of said tongue from said raised position toward its lowered position effecting a one-way, irreversible by-pass of said locking parts, to thereby permanently secure the tongue in its lowered position and thus retain the closure cap part in its closed, sealing position.

5. A cap construction as claimed in claim 4, and further including:

a) frangible means connecting said tongue to said closure cap part, b) forcible removal of said closure cap part from said cap body part effecting a rupturing of said frangible means, indicating the closure cap construction has been tampered with.

6. A tamper-evident, one-piece molded plastic closure cap construction, comprising in combination:

a) a cap body part having means for attachment to a container neck, said cap body part having an upper discharge opening, b) a closure cap part, and hinge means connecting said closure cap part to said cap body part, said closure cap part being movable between a closed, sealing position overlying said discharge opening, and an open, discharge position wherein the closure cap part is removed from the discharge opening, and c) cooperable locking and indicator means disposed on and integral with said cap body part and closure cap part, said locking and indicator means being located diametrically opposite said hinge means and constituting a manually operable locking part which is adapted to secure the closure cap part in said closed, sealing position against dislodgement therefrom only after the closure cap part has first been placed in said sealing position, d) said locking part constituting a readily visible movable and accessible indicator disposed at the top of the closure cap construction, said locking part being engageable with said body part and being automatically actuatable to a non-locking position in response to movement of the closure cap part to its closed, sealing position and said locking part being adapted to show whether or not it is in its locking position.

7. A cap construction as claimed in claim 6, wherein:

a) said locking and indicator means comprises a round retainer pin on the closure cap part, comprises resilient means mounting the pin on said closure cap part, and comprises a socket in the cap body part, in which the round pin is frictionally receivable.

8. A cap construction as claimed in claim 6, wherein:

a) said locking part comprises a tongue on the closure cap part and a round retainer pin carried by the tongue, b) said locking and indicator means including a socket in the cap body part, in which the retainer pin is frictionally received, c) said tongue being hingedly connected to the said closure cap part.

9. A cap construction as claimed in claim 8, wherein:

a) the hinge connection of the tongue comprises a zone of weakness adapted to tear readily upon the application of force thereto.

10. A cap construction as claimed in claim 9, wherein:

a) the closure cap part has a plateau portion with a recess in which the said tongue is received.

11. A cap construction as claimed in claim 10, wherein:

a) the said tongue occupies a depressed position in the recess when the locking part is in its locking position.

12. A cap construction as claimed in claim 10, wherein:

a) the said tongue slopes in an upward direction from the recess when the locking part is in its non-locking position.

13. A cap construction as claimed in claim 10, wherein:

a) said plateau portion constitutes a finger tab for lifting the closure cap part from the cap body part to effect a tearing of the zone of weakness of the tongue.

14. A cap construction as claimed in claim 13, wherein:

a) said tongue is connected to the finger tab at the said zone of weakness.

* * * * *